US006234875B1

(12) United States Patent
Pendergrass, Jr.

(10) Patent No.: US 6,234,875 B1
(45) Date of Patent: May 22, 2001

(54) METHOD OF MODIFYING A SURFACE

(75) Inventor: Daniel B. Pendergrass, Jr., Mendota Heights, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/328,916

(22) Filed: Jun. 9, 1999

(51) Int. Cl.[7] ..... B24B 1/00

(52) U.S. Cl. ..... 451/41; 451/527; 451/530; 51/298; 438/692; 256/79.4

(58) Field of Search ..... 451/41, 527, 530, 451/290; 438/692, 693, 645; 252/79.4; 156/636.1, 345; 51/298

(56) References Cited

U.S. PATENT DOCUMENTS

| | | | | |
|---|---|---|---|---|
| 4,244,775 | | 1/1981 | D'Asaro . | |
| 4,732,648 | | 3/1988 | Fronius et al. . | |
| 5,152,917 | | 10/1992 | Pieper et al. . | |
| 5,399,528 | | 3/1995 | Leibovitz et al. . | |
| 5,578,362 | | 11/1996 | Reinhardt et al. . | |
| 5,609,517 | | 3/1997 | Lofaro . | |
| 5,643,044 | | 7/1997 | Lund . | |
| 5,692,950 | | 12/1997 | Rutherford et al. . | |
| 5,759,427 | | 6/1998 | Cibulsky et al. . | |
| 5,759,917 | | 6/1998 | Grover et al. . | |
| 5,778,481 | | 7/1998 | Amsden et al. . | |
| 5,791,969 | | 8/1998 | Lund . | |
| 5,975,988 | * | 11/1999 | Christianson | 451/28 |
| 6,022,268 | | 2/2000 | Roberts et al. . | |
| 6,056,794 | * | 5/2000 | Stoetzel et al. | 51/298 |

FOREIGN PATENT DOCUMENTS

| | | |
|---|---|---|
| 198 28 477 A1 | 1/1999 | (DE) . |
| 0 806 267 A1 | 11/1997 | (EP) . |
| 8-11050 | 1/1996 | (JP) . |
| 9-148285 | 6/1997 | (JP) . |
| 9-171982 | 6/1997 | (JP) . |
| WO 93/18891 | 9/1993 | (WO) . |
| 98/30356 | 7/1998 | (WO) . |
| 98/35786 | 8/1998 | (WO) . |
| WO 98/49723 | 11/1998 | (WO) . |

OTHER PUBLICATIONS

Article entitled "Segmental Orientation Studies of Block Polymers. I. Hydrogen–Bonded Polyurethanes" by Robert W. Seymour, A.E. Allegrezza, Jr., and Stuart L. Cooper, Department of Chemical Engineering, University of Wisconsin, Madison, Wisconsin, received Jul. 2, 1979.

Encyclopedia of Polymer Science and Engineering, vol. 9, pp. 760–788, entitled Liquid Crystalline Polymers to Mining Applications, dated 1987.

"Block Polymers and Related Heterophase Elastomers", pp. 313–314. by G.M. Estes, S.L. Cooper, and A.V. Tobolsky, Copyright © 1970 by Marcel Dekker, Inc.

* cited by examiner

*Primary Examiner*—Joseph J. Hail, III
*Assistant Examiner*—George Nguyen

(57) ABSTRACT

A method of modifying a surface comprising the steps of: (a) contacting the surface to be modified with a working surface of an abrasive article, the abrasive article comprising a phase separated polymer having a first phase and a second phase, the first phase being harder than the second phase; and (b) relatively moving the surface to be modified and the fixed abrasive article to remove material from the surface to be modified in the absence of an abrasive slurry.

26 Claims, 2 Drawing Sheets

METHOD OF MODIFYING A SURFACE

The present invention relates to methods for abrading or polishing a surface such as the surface of a structured semiconductor wafer and the like.

BACKGROUND

During integrated circuit manufacture, semiconductor wafers used in semiconductor fabrication typically undergo numerous processing steps including deposition, patterning, and etching. Details of these manufacturing steps for semiconductor wafers are reported by Tonshoff et al., "Abrasive Machining of Silicon", published in the *Annals of the International Institution for Production Engineering Research,* (Volume 39/2/1990), pp. 621–635. In each manufacturing step, it is often necessary or desirable to modify or refine an exposed surface of the wafer to prepare it for subsequent fabrication or manufacturing steps.

In conventional semiconductor device fabrication schemes, a flat, base silicon wafer is subjected to a series of processing steps that deposit uniform layers of two or more discrete materials to form a single layer of a multilayer structure. In this process, it is common to apply a uniform layer of a first material to the wafer itself or to an existing layer of an intermediate construct by any of the means commonly employed in the art, to etch pits into or through that layer, and then to fill the pits with a second material. Alternatively, features of approximately uniform thickness comprising a first material may be deposited onto the wafer, or onto a previously fabricated layer of the wafer, usually through a mask, and then the regions adjacent to those features may be filled with a second material to complete the layer. Following the deposition step, the deposited material or layer on a wafer surface generally needs further processing before additional deposition or subsequent processing occurs. When completed, the outer surface is substantially globally planar and parallel to the base silicon wafer surface. A specific example of such a process is the metal Damascene processes.

In the Damascene process, a pattern is etched into an oxide dielectric (e.g., silicon dioxide) layer. After etching, optional adhesion/barrier layers are deposited over the entire surface. Typical barrier layers may comprise tantalum, tantalum nitride, titanium or titanium nitride, for example. Next, a metal (e.g., copper) is deposited over the dielectric and any adhesion/barrier layers. The deposited metal layer is then modified, refined or finished by removing the deposited metal and optionally portions of the adhesion/barrier layer from the surface of the dielectric. Typically, enough surface metal is removed so that the outer exposed surface of the wafer comprises both metal and an oxide dielectric material. A top view of the exposed wafer surface would reveal a planar surface with metal corresponding to the etched pattern and dielectric material adjacent to the metal. The metal(s) and oxide dielectric material(s) located on the modified surface of the wafer inherently have different physical characteristics, such as different hardness values. The abrasive treatment used to modify a wafer produced by the Damascene process must be designed to simultaneously modify the metal and dielectric materials without scratching the surface of either material. The abrasive treatment must create a planar outer exposed surface on a wafer having an exposed area of a metal and an exposed area of a dielectric material.

The process of modifying the deposited metal layer to expose the dielectric material leaves little margin for error because of the submicron dimensions of the metal features located on the wafer surface. The removal rate of the deposited metal should be relatively high to minimize manufacturing costs, and the metal must be completely removed from the areas that were not etched. The metal remaining in the etched areas must be limited to discrete areas or zones while being continuous within those areas or zones to ensure proper conductivity. In short, the metal modification process must be uniform, controlled, and reproducible on a submicron scale.

One conventional method of modifying or refining exposed surfaces of structured wafers treats a wafer surface with a slurry containing a plurality of loose abrasive particles dispersed in a liquid. Typically this slurry is applied to a polishing pad and the wafer surface is then ground or moved against the pad in order to remove material from the wafer surface. Generally, the slurry may also contain chemical agents or working liquids that react with the wafer surface to modify the removal rate. The above described process is commonly referred to as a chemical-mechanical planarization (CMP) process. Certain shortcomings to the traditional CMP process have been noted. For example, it is expensive to dispose of the used slurries in an environmentally sound manner. In addition, residual abrasive particles can be difficult to remove from the surface of the semiconductor wafer following the polishing operation. If not removed, these residual particles may contribute to electrical and mechanical failure of the finished semiconductor devices.

A recent alternative to CMP slurry methods uses an abrasive article to modify or refine a semiconductor surface and thereby eliminate the need for the foregoing slurries. This alternative CMP process is reported, for example, in International Publication No. WO 97/11484, published Mar. 27, 1997. The reported abrasive article has a textured abrasive surface which includes abrasive particles dispersed in a binder. In use, the abrasive article is contacted with a semiconductor wafer surface, often in the presence of a working liquid, with a motion adapted to modify a single layer of material on the wafer and provide a planar, uniform wafer surface. The working liquid is applied to the surface of the wafer to chemically modify or otherwise facilitate the removal of a material from the surface of the wafer under the action of the abrasive article.

The above-mentioned working liquids may comprise any of a variety of liquids such as water or, more typically, aqueous solutions of complexing agents, oxidizing agents, passivating agents, surfactants, wetting agents, buffers, rust inhibitors, lubricants, soaps, combinations of these additives, or the like. Additives may also include agents which are reactive with the second material, e.g., metal or metal alloy conductors on the wafer surface such as oxidizing, reducing, passivating, or complexing agents.

It is desirable to provide improvements in CMP processes. It is especially desirable to provide improvements in CMP processes by utilizing abrasive articles exhibiting a higher degree of selective planarization than those produced with conventional slurry based processes. It is also desirable to provide processes that employ abrasive articles free of traditional abrasive particles while still being effective in a CMP process without the need for the aforementioned slurries.

SUMMARY OF THE INVENTION

The present invention provides a method of modifying an exposed surface of a semiconductor wafer comprising the steps of: (a) contacting the exposed surface of a semiconductor wafer with a surface of an abrasive article, the abrasive article comprising a phase separated polymer having at least two phases of differing hardnesses; and (b) relatively moving the wafer and the fixed abrasive article to remove material from the surface of the wafer in the absence of an abrasive slurry.

The phase separated polymer may be selected from any of a variety of phase separated polymers wherein the work to failure for the phase separated polymer is greater than the work-to-failure for the material removed from the surface of the wafer. In this context, "work-to-failure" means the integrated area under the stress/strain failure curve for a particular material. The area under such a curve has units of work. In general, the phase separated polymer is a block copolymer selected from the group consisting of A-B diblock copolymer, A-B-A triblock copolymer, A-B-A-B tetrablock copolymer and A-B multiblock and star block copolymer. In a preferred embodiment, the phase separated polymer is a styrene-butadiene-styrene copolymer or a styrene-ethylene-butadiene-styrene copolymer. In these copolymer systems, styrene is present within the phase separated polymer in an amount sufficient to form hard segment domains having an average diameter between about 50 Angstroms and about 1000 Angstroms. If desired, larger discrete domains may often be created by blending the block polymer with homopolymer corresponding to the composition of the discrete domains.

In referring to aspects of the invention, certain terms will be understood to have the following meanings:

"Abrasive composite" refers to one of a plurality of shaped bodies which can collectively provide an abrasive surface. In this context, "three-dimensional abrasive surface" is an abrasive surface having an undulated surface topography of raised and depressed abrasive portions.

"Precisely shaped," in reference to the abrasive composites, refers to a shape that is readily discernible by the human eye and can be readily reproduced during the manufacturing process (e.g., by molding) to provide an entire abrasive surface of precisely shaped abrasive composites.

These and other aspects of the invention will be understood by those skilled in the art after consideration of the remainder of the disclosure including the Detailed Description Of The Preferred Embodiment and the appended claims.

DETAILED DESCRIPTION OF THE PREFERRED EMBODIMENT

Figure 1:
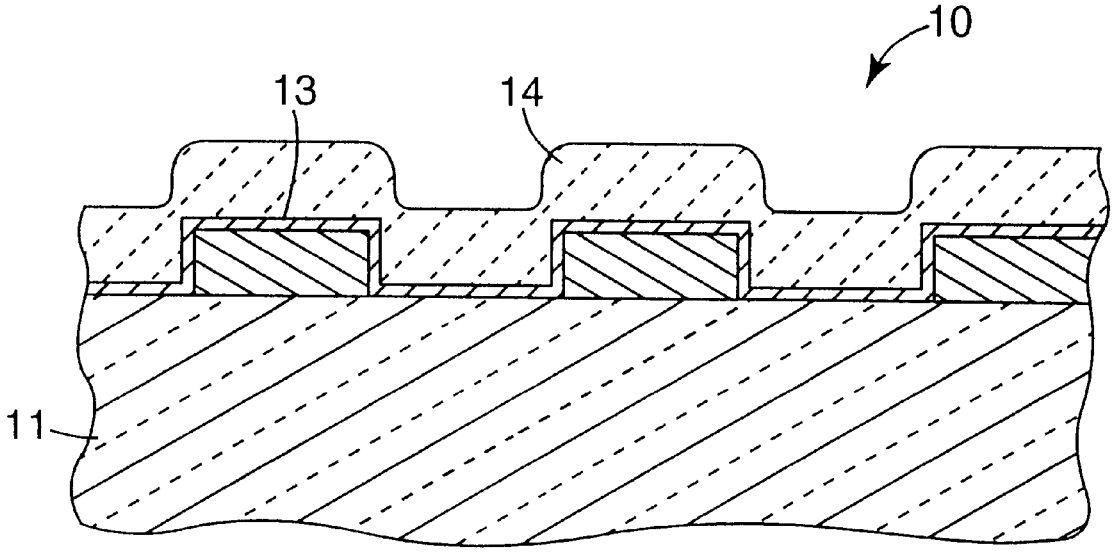
FIG. 1 is a schematic cross sectional view of a portion of a structured wafer before surface modification.

The invention will be described by reference to its preferred embodiment. In this detailed description, reference will be made to the various figures where certain features are identified by reference numerals and wherein like numerals indicate like features.

FIG. 1 is a representative view of a patterned wafer 10 suitable for use in the process of the invention. For clarity, known features such as doped regions, active devices, epitaxial layers, carrier and field oxide layers have been omitted. Wafer 10 has a base 11 typically made from any appropriate material such as single crystal silicon, gallium arsenide, and other materials known in the art. A barrier or adhesion layer 13, typically titanium nitride, titanium, tantalum, tantalum nitride or silicon nitride covers the base layer 11 and base features.

Figure 2:
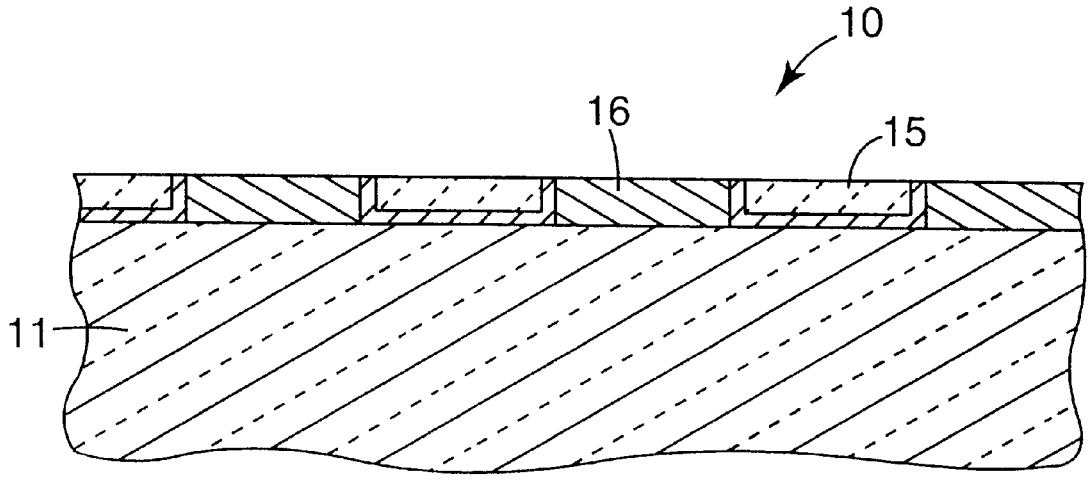
FIG. 2 is a schematic cross sectional view of a portion of a structured wafer after surface modification.

A metal conductor layer 14 covers the front surface of barrier layer 13 and base features. A variety of metal or metal alloys may be used such as titanium, aluminum, copper, aluminum copper alloy, tungsten, or silver. The metal layer is typically applied by depositing a continuous layer of the metal on barrier layer 13. Excess metal is then removed to form the desired pattern of metal interconnects 15 as illustrated in FIG. 2. Metal removal provides discrete metal interconnect surfaces 15 and discrete feature surfaces 16 that preferably provide a planar surface free of scratches or other defects that could interfere with the operability of the finished semiconductor device.

Figure 3:
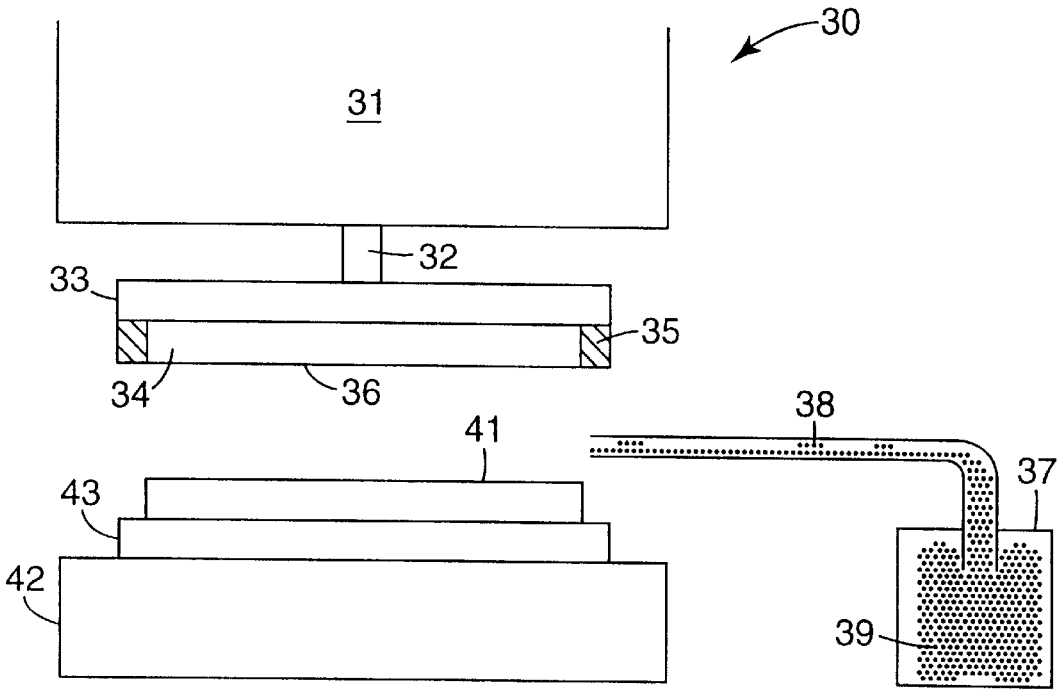
FIG. 3 is a partial side schematic view of one apparatus for modifying the surface of a wafer used in semiconductor fabrication.

FIG. 3 schematically illustrates an apparatus for modifying wafers and useful in the CMP process. Variations of this machine and/or numerous other machines may be useful with this invention. This type of apparatus is known in the art for use with polishing pads and loose abrasive slurries. An example of a suitable, commercially available apparatus for the CMP process is that available from IPEC/WESTECH of Phoenix, Ariz. Alternative machines for the CMP process are available from STRASBAUGH or SPEEDFAM. Still other machines adapted to accommodate webs or polishing tapes are described in, for example, U.S. Pat. Nos. 5,643,044 and 5,791,969, both to Lund. The apparatus 30 comprises head unit 31 connected to a motor (not shown). Chuck 32 extends from head unit 31. An example of such a chuck is a gimbal chuck. The design of chuck 32 preferably accommodates different forces and pivots so that the abrasive article provides the desired surface finish and flatness on the wafer. However, the chuck may or may not allow the wafer to pivot during planarization.

At the end of chuck 31 is wafer holder 33 securing wafer 34 to head unit 31 and preventing the wafer from becoming dislodged during processing. The wafer holder is designed to accommodate the wafer and may be, for example, circular, oval, rectangular, square, octagonal, hexagonal, or pentagonal. In some instances, the wafer holder includes two parts, an optional retaining ring and a wafer support pad. The retaining ring may be a generally circular device that fits around the periphery of the semiconductor wafer. The wafer support pad may be fabricated from one or more elements, e.g., polyurethane foam. Wafer holder 33 extends alongside of semiconductor wafer 34 at ring portion 35. The optional ring portion may be a separate piece or may be integral with holder 33. As shown in FIG. 3, wafer holder 33 may be constructed so that ring portion 35 does not extend beyond the surface 36 of wafer 34. In this configuration, the wafer holder 33 will not touch or contact the working surface 41 of the abrasive article. In other instances, the ring portion 35 of the wafer holder 33 may extend beyond the surface 36 of wafer 34. In this arrangement of parts, the ring portion 35 will make contact with the abrasive surface 41 and thereby influence the characteristics of the abrasive composite by, for example, providing the wafer holder 33 with a construction suitable to "condition" the abrasive surface by removing the outermost portion of the surface during processing. The wafer holder or retaining ring may be of any design or material which will allow the abrasive article to impart the desired degree of modification to the wafer. Examples of suitable materials include polymeric materials.

The speed at which wafer holder 33 rotates will depend on the particular apparatus, processing conditions, abrasive article, and the desired wafer modification criteria. In general, however, wafer holder 33 rotates between about 2 to about 1,000 rpm, typically between about 5 to about 500 rpm, preferably between about 10 to about 300 rpm and more preferably between about 20 to about 100 rpm. If the wafer holder rotates too slowly or too fast, then the desired removal rate may not be achieved. Wafer holder 33 and/or the base 42 may rotate in a circular fashion, a spiral fashion, a non-uniform manner, an elliptical fashion such as a figure eight or in a random motion. The wafer holder frequently translates along a radius of the abrasive article. The wafer holder or base may also oscillate or vibrate, such as by transmitting ultrasonic vibrations through the holder or base.

The process of the invention is as described above, utilizing an abrasive article having a working surface suitable for abrading the surface of a workpiece such as a layer of a structured semiconductor wafer. The process of the invention does not require the use of an abrasive slurry. The working surface of the article comprises a textured working surface, preferably comprising plurality of raised regions, for abrading or polishing the structured wafer surface either alone or in the presence of a suitable chemical environment. Each of the raised contact regions will typically comprise a plurality of domains of each of the polymeric phases present.

Figure 4:
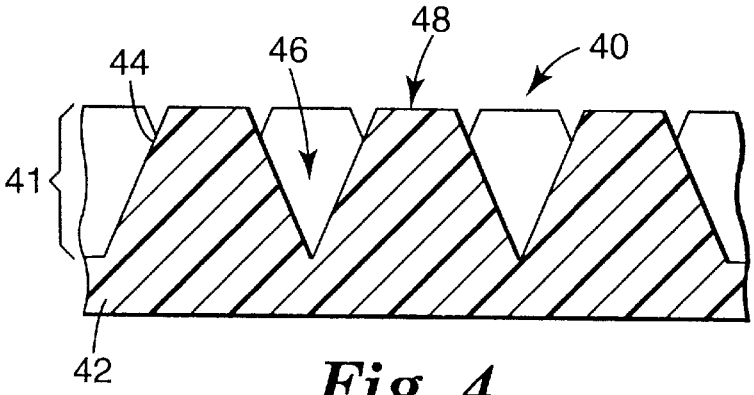
FIG. 4 is a cross sectional view of a portion of an abrasive article useful in the method of the present invention.

Referring to FIG. 4, a preferred construction for an abrasive article useful in the process of the present invention is shown and will now be described. The abrasive article 40 includes an abrasive surface, generally indicated by the reference numeral 41. The abrasive surface 41 is affixed to one major surface of the base 42 and preferably comprises a plurality of abrasive composites 44 affixed to the base 42. The composites 44 may be integrally molded to the base or affixed thereto by an adhesive or the like. Preferably, the abrasive surface includes open channels, generally indicated at 46, extending between the composites 44 to facilitate the circulation of a working liquid along the entire surface 41 when the abrasive article 40 is used in a CMP process. Working liquids are known and may be used, for example, to cool the interface between the semiconductor wafer and the abrasive surface 41, to carry appropriate chemicals to the interface, to remove dross released by the polishing operation, or combinations of these and other functions. It will be appreciated that the relative volume of the channels 46 and the composites 44 may vary depending on the demands of a specific polishing operation. However, the channels 46 will typically occupy between 5 and 95 percent of the volume between the working surface 48 and the plane of the bases of the composites and preferably between 50 and 80 percent of such volume.

Useful abrasive articles may also include a backing (not shown) affixed to the surface of the base 42 opposite the composites 44. Known coated abrasive backings are suitable for use in the abrasive articles. The backing can be flexible, or alternatively the backing can be more rigid. Examples of typical flexible abrasive backings include polymeric film, primed polymeric film, metal foil, cloth, paper, vulcanized fiber, nonwovens and treated versions thereof and combinations thereof. The backing may also contain a treatment to modify its physical properties. Another example of a backing is described in U.S. Pat. No. 5,417,726 incorporated herein after by reference. Examples of more rigid backings include metal plates, ceramic plates, treated nonwoven substrates, treated cloth and the like. The backing may also consist of two or more backings laminated together. The backing may also consist of reinforcing fibers engulfed in a polymeric material as disclosed in PCT published application WO93/12911.

Preferred backings for semiconductor wafer planarization are very uniform in their thickness. If the backing does not have uniform thickness, this can lead to greater variability in intermediate semiconductor wafer flatness after planarization. One preferred type of backing is a polymeric films and examples of such films include polyester films, polyester and co-polyester films, microvoided polyester films, polyimide films, polyamide films, polyvinyl alcohol films, polypropylene film, polyethylene film and the like. There should also be good adhesion between the polymeric film backing and the abrasive article or coating. In many instances, the polymeric film backings are primed. The primer can be a surface alteration or chemical type primer. Examples of surface alterations include corona treatment, UV treatment, electron beam treatment, flame treatment and scuffing to increase the surface area. Examples of chemical type primers include ethylene acrylic acid copolymer as disclosed in U.S. Pat. No. 3,188,265, colloidal dispersions as taught in U.S. Pat. No. 4,906,523, aziridine type materials as disclosed in U.S. Pat. No. 4,749,617 and radiation grafted primers as taught in U.S. Pat. Nos. 4,563,388 and 4,933,234. The thickness of the polymeric film backing generally ranges between about 20 to 1000 micrometers, preferably between 50 to 500 micrometers and more preferably between 60 to 200 micrometers.

The abrasive composites 44 preferably comprise a phase-separated polymer system having a first or "hard" phase and a second or "soft" phase wherein the hard phase comprises the hard segments of the polymer and the soft phase comprises the soft segments of the polymer. The hard phase of the phase separated polymer is harder than the soft phase, and the hard phase may be characterized by its glass transition temperature ($T_g$) which is preferably greater than the temperature of the working surface of the article during use in a CMP process. Typically, the $T_g$ of the hard segment will be greater than about 49° C. and generally between about 10° C. and about 100° C. The soft phase of the phase separated polymer may be characterized by its glass transition temperature which is preferably less than the temperature of the working surface of the article during use in a CMP process. In such a phase separated polymer system, the harder phase of the polymer will function in a manner analogous to abrasive grit during a CMP process while the softer phase of the polymer will promote local conformity of the pad to the surface of the structured wafer being polished. The soft phase preferably will have sufficient resilience to allow surface asperities to project beyond the plane of the active grit and to be sheared off as the grit passes. Those skilled in the art will appreciate that the morphology of the harder phase may be varied by changing the relative molar volumes of the hard and soft phases.

In the formulation of the composites 44, A-B block polymers may be used where one of the components forms the aforementioned hard segments and the other component forms the softer segments. The polymer system may also be an A-B-A type bock copolymer or a polymer providing a so-called star block configuration. It is also expected that microphase separated urethanes (e.g. Estanes) may be used in some CMP polishing applications. In the broadest aspects of the invention, a polymeric material is considered useful in formation of the composites if the integrated area under the stress vs strain to failure curve (work-to-failure) is greater than the corresponding work-to-failure for the material to be removed. To promote selectivity in material removal, it may be desirable for the work-to-failure of the polymeric material to be greater than the corresponding work-to-failure for the material to be removed while being less than the work-to-failure of the underlying dielectric layer and/or any adhesion/barrier layers underlying the material to be removed.

One preferred polymeric system for use in the abrasive composites 44 is a styrene-butadiene-styrene (SBS) block copolymer system. In general, the SBS system is inexpensive, easy to fabricate by thermoforming or solvent casting, and may readily be structurally modified to adapt to different polishing applications. In this system, the styrene phase is capable of abrading copper during a CMP process and is especially capable of abrading the copper compounds which form when a copper surface is exposed to an oxidizing environment resulting from the application of a working liquid (e.g., a solution of hydrogen peroxide) to the copper metal deposited onto the structured wafer during a dual Damascene process, for example. Working liquids useful in CMP processes are known to those skilled in the art and are not further described herein. Examples of such working liquids may be found in pending U.S. patent application Ser. No. 09/091,932, filed on Jun. 24, 1998 and in U.S. patent application Ser. No. 09/266,208, filed on Mar. 10, 1999.

In the SBS system and at relatively low weight fractions of styrene, the styrene phase will act as an abrasive grit and is likely to assume the form of spheres uniformly dispersed in a butadiene matrix. The styrene phase. is covalently bonded to the remaining polymeric matrix and is thus unlikely to detach from the matrix during a polishing operation. As the styrene content is increased in the SBS formulation, the domains of styrene will grow and may assume a cylindrical configuration or the like within the SBS polymeric system. As the styrene content in the SBS is increased further, the SBS system will eventually become bicontinuous and then assume a lamellar structure in which layers of styrene alternate with layers of butadiene. Further increases in the styrene content will pass through a second bicontinuous domain arrangement to give rise to a structure in which styrene is the continuous phase and the butadiene portion of the system forms a well dispersed population of cylinders and then spheres. Further details of the morphologies of phase separated polymer systems can be found in *Encyclopedia of Polymer Science and Technology,* vol.9, pp 760–788, John Wiley & Sons (1987).

When the SBS polymer system is used in the abrasive article to form the composites, the styrene content within the SBS system typically will be within the range from about 10 wt % to about 90 wt %. Most preferably from about 15 wt % to about 40 wt %. In contrast to conventional mineral abrasives, any polymeric residue transferred to the workpiece can be readily removed by the same processing conditions used to remove the polymeric masks deposited as part of the wafer fabrication process. Preferably, the styrene phase in the SBS polymer forms small regions similar or analogous to an abrasive particle having an average diameter between about 50 Angstroms (Å) and about 1,000 Å. Commercially available block copolymers suitable for use in the aforementioned abrasive articles include those known under the trade designation KRATON D1101, a linear styrene-butadiene-styrene block copolymer having a sytrene:butadiene weight ratio of 31:69 and available from Shell Chemical Company of Houston, Tex. Another suitable polymer is a linear styrene-ethylene-butadiene-styrene copolymer having a sytrene:rubber weight ratio of 29:71 and available from the Shell Chemical Company under the trade designation KRATON G1650.

If desired or needed, pendant functional groups can be added to the polymer system to enhance wetting of the abrasive surface, for example. One desired modification of the SBS polymer system may be accomplished by sulfonation of a fraction of the styrene groups of the block polymer to enhance the ability of aqueous chemistry commonly employed in CMP processes to more uniformly wet the abrasive article during use as well as to reduce friction and/or help to sequester metal or metal ions as they are removed from the surface of the semiconductor wafer.

In the depicted embodiment, the abrasive composites 44 have a discernible precise shape in the form of truncated pyramids. However, the composites may be provided in any of a variety of shapes such as cylinders (or posts), pyramids, cubes and the like. Additionally, a single abrasive article may include differently configured composites thereon. The composites may be shaped to include working surfaces 48 that are essentially coplanar, as in FIG. 4. Alternatively, the individual working surfaces may be tilted with respect to the base 42 in such a manner that the individual working surfaces do not lay within the same plane but may lay within more than one plane. Some of the composites may include surfaces that are within the same plane while other composites in the same article are in different planes. Additionally, the individual composites may be a combination of configurations with a first configuration at the base of the article and a second configuration at the working surface of the composite. For example, the composite may have a cross section corresponding to a six pointed star at the base and a circular cross section at the initial working surface. The transition from one configuration to the next within any single composite may be a continuous transition or it may be an abrupt or discontinuous transition.

For ease of manufacture, the composites may be formed as a periodic array. However, the articles useful in the invention may include a working surface that is comprised of a random array of composites. Preferably, the composites 44 of the abrasive surface 41 will be comprised of the phase separated polymer as described above. It is also contemplated, however, that the individual composites 44 may comprise other materials in addition to the phase separated copolymer. For example, the composites may include the phase separated polymer in one region of the composite extending from the working surface 48 to a defined distance therefrom. The remainder of the composite may comprise another material suitable for supporting the phase separated polymer. The phase separated polymer may be provided as a thin coating over a contoured article where the contoured article may be either more rigid or less rigid than the phase separated polymer depending on the characteristics of the workpiece. The working surface of the composite may also include a fine structure such as grooves or the like to improve local supply/drainage of working liquid and to avoid or reduce the trapping of debris which might give rise to scratches.

While the abrasive surface 41 preferably will comprise a plurality of abrasive composites such as the composites 44 depicted in FIG. 4, it will be appreciated that other configurations for the abrasive surface are also within the scope of the invention and those skilled in the art will appreciate that the invention is not limited to any particular configuration for the abrasive surface. The working surface of the abrasive article will preferably be textured in some manner and will comprise a polymeric system consistent with the aforementioned description. Preferably, the textured abrasive surface of the invention will be configured in a manner that permits the exertion of essentially uniform pressure on the article to be polished during a CMP process. In general, the articles most useful in the present invention are characterized by an abrasive surface comprising a phase separated polymer that includes hard segments and soft segments, as described herein.

Abrasive articles useful in the present invention can be manufactured using a number of different but known manufacturing methods such as by molding or embossing, for example. The embossing process should be carried out using either a platen or an embossing roll and the temperature of the polymer during the embossing step should be above the glass transition temperature of the hard segment of the phase separated step polymer. The manufacture of these articles is further illustrated in the Examples. The articles useful in the method of the present invention may be provided in any of a variety of configurations. For example, the articles may be provided as pads wherein the abrasive surface that contacts the semiconductor wafer is essentially circular. Alternatively, the abrasive article may be provided as a web or in sheet form wherein the abrasive article may be rolled and mounted in rolled form on a suitable CMP machine to provide a fresh abrasive surface at any time during the CMP operation. Other forms for the abrasive article may also be possible and those skilled in the art will appreciate that the invention is not limited to the use of an abrasive article that is in any particular format.

It is anticipated that the semiconductor wafers processed with the aforementioned abrasive articles will have a higher degree of selective planarization than those produced with conventional slurry based processing because the hard segments in the chosen polymer system may be selected to remove metal, for example, while leaving the dielectric material untouched. In addition, the wafer planarization process would be essentially free from free abrasive particles in the working fluid and therefore the working fluid should require much less effort to clean. The working fluid should be readily recycled by using simple filtration or other known methods to remove the dross. Similar benefits would accrue in other polishing operations.

The invention is further illustrated in the non-limiting examples set forth below.

EXAMPLES

The following procedures were employed herein.

Procedure I

Copper coated blanket wafers were made from a single crystal silicon base unit having a diameter of 100 mm and a thickness of about 0.5 mm; purchased from either WaferNet or Silicon Valley Microelectronics, both of San Jose, Calif. Before deposition of the metal layer, a silicon dioxide layer approximately 5,000 Å thick was grown on the silicon wafer. A titanium adhesion/barrier layer was deposited on the silicon dioxide layer prior to metal deposition. The thickness of Ti was typically 200 Å, but may range between 100 and 300 Å. A uniform layer of Cu was then deposited over the silicon base using physical vapor deposition (PVD). The thickness of the metal layer was typically between 11,000 and 12,000 Å, and measured by an Omnimap NC110 Non-contact Metals Monitoring System, TENCOR Instruments, Prometrix Division, Santa Clara, Calif.

The test machine was a modified Strasbaugh Lapping Machine, Model 6Y-1. The wafer workpiece was rested on a foam backing available from Rodel of Newark, Del., under the designation "DF200", and the assembly was placed into a spring loaded plastic retaining ring. The abrasive article of the example was adhered to a support pad comprising a 20 mil "PCF20" polycarbonate sheet obtained from General Electric Structured Plastics, General Electric Corp., Schenectady, N.Y., laminated with a 3M adhesive 442 DL or 9671LE obtained from 3M, St. Paul, Minn., to a 90 mil ethylene vinyl acetate closed-cell foam from Voltek, Division of Sekisui America Corp., Lawrence, Mass.; the pad was affixed to the platen of the Strasbaugh.

The carrier head holding the wafer was brought into contact with an abrasive article made according to Procedure III herein. The wafer was rotated at about 40 rpm and the platen was rotated at the same speed as the carrier head. Both the wafer and the abrasive article rotated in a clockwise manner. In addition to rotating, the wafer moved through an arc (approximately 31 mm with a 9 second periodicity) starting about 13 mm from the edge of the abrasive article. The platen was 12 inches in diameter. The abrasive article and carrier head were brought into contact with one another at a downforce of about 350 KPa (50 pounds) unless otherwise specified. The working liquid was pumped onto the abrasive article before contacting the wafer. During polishing, the working liquid was pumped onto the wafer and abrasive interface at a flow rate of about 40 ml/minute. The abrasive article was used to polish the blanket wafers for a one minute (60 second) cycle. After the polishing cycle, each wafer was removed from the holder and replaced.

The metal removal rate was calculated by determining the change in metal film thickness. Initial (i.e., before polishing) and final (i.e., after polishing) measurements were taken at the same locations on the NC110. Five readings were averaged to determine the removal rate in Angstroms per minute (Å/min). The standard deviation of differences divided by the mean of the differences is reported as % NU or % non-uniformity. "Non-uniformity" is a measure of how uniform the removal rate of copper is across the surface of the wafer. A low number for non-uniformity (e.g., 2 to 3%) is generally preferred.

Procedure II (Working Liquids)

Working liquids were prepared using the ingredients listed below. Semiconductor grade hydrogen peroxide was obtained from Olin Corp. (Norwalk, Conn.) as a 30% solution and was diluted as necessary. Ammonium hydrogen phosphate (ACS reagent grade), iminodiacetic acid, ammonium citrate (a chelating agent), and 1-H-benzotriazole (BHT) were all obtained from Aldrich Chemical Company, Milwaukee, Wis. Solids were weighed separately and dissolved in water with the 30% hydrogen peroxide solution added last (when ready to polish) to give the proper dilution. The balance of each solution was deionized water. The total weight for the working liquid was 1000 g, corresponding to approximately 1 liter. The pH of the final solution was about 7.4.

Composition of Working Liquid 3.0% ammonium hydrogen phosphate
3.3% hydrogen peroxide
0.5% ammonium citrate
0.10% 1-H-benzotriazole (BTA)
93.1% water Procedure III (Manufacture of Abrasive Articles)

Abrasive articles were fabricated from a block polymer system for use in copper polishing operations. The articles were manufactured from commercially available polymers available under the trade designations KRATON G1650 and KRATON D1101. A sample was prepared for compression molding by sequentially stacking the following: a cardboard sheet, a chrome plated brass plate, a 16 inch×16 inch (40.6 cm×40.6 cm) nickel embossing tool, a layer of polymer granules, a second chrome plated brass plate, and a second cardboard sheet. The stack was placed in a compression molder (Wabash Model V75H-24-CLX obtained from Wabash MPI, Wabash, Id.) and molded at the prescribed pressure, time, and temperature. The stack was then cooled to the desired temperature under pressure. The stack was removed from the molder and disassembled to provide a monolithic polymer sample.

The nickel embossing tool was configured to produce an array of truncated pyramids which are nominally 0.0035 in (88.9 micron) high on 0.00585 in (148.6 micron) centers in a square array. The post tops are initially 0.00341 in (86.6 micron) square and the sides slope at 10° from the vertical. The posts comprise approximately 47% of the volume of the abrasive surface (e.g., between the planes defined by the bases of the pyramids and by the tops of the pyramids) leaving about 53% of the abrasive surface volume for flow channels.

Example 1

An abrasive article was prepared according to the Procedure III using approximately 900 ml KRATON D1101 SBS block co-polymer pellets. The article was molded under 30 tons (30,480 kg), at 160° C. for two minutes, cooled to less than 70° C. and removed from the stack to yield an article approximately 75 mil (1.9 mm) thick. The article was tested on a copper blanket wafer. The blanket wafer and the test were according to the Procedure I. Process conditions included a 40 rpm platen speed, 40 rpm carrier speed and a 40 ml/min flow for the working liquid. The testing was conducted using a single abrasive article with a new wafer being used in the test after each 60 second test interval. Test results are set forth in Table 1

TABLE 1

| Wafer | Time (seconds) | Cu Remaining (Å) | Removal Rate (Å/min) | % NU |
|---|---|---|---|---|
| 12 | 60 | 11800 | 35.36 | 134 |
| 11 | 60 | 10930 | 255.2 | 48.3 |
| 10 | 60 | 10640 | 1049 | 35.1 |
| 9 | 60 | 9000 | 2826 | 5.77 |
| 8 | 60 | 8163 | 2804 | 10.0 |
| 7 | 60 | 8136 | 2836 | 8.01 |
| 6 | 60 | 8122 | 2812 | 10.9 |
| 5 | 60 | 8161 | 2772 | 10.9 |
| 4 | 60 | 8095 | 2837 | 6.99 |
| 3 | 60 | 8055 | 2863 | 11.0 |

Example 2

An abrasive article was prepared according to the Procedure III using approximately 400 ml KRATON G1650 SBS block co-polymer pellets. The article was molded under 50 tons (50,800 kg), at 190° C. for two minutes, cooled to less than 70° C. and removed from the stack to yield an article approximately 25–30 mil (0.64–0.76 mm) thick. The article was tested on a copper blanket wafer. The blanket wafer and the test were according to the Procedure I. Process conditions included a 40 rpm platen speed, 40 rpm carrier speed and a 40 ml/min flow for the working liquid. The testing was conducted using a single abrasive article with a new wafer being used in the test after each 60 second test interval. Test results are set forth in Table 2.

TABLE 2

| Wafer | Time (seconds) | Cu Remaining (Å) | Removal Rate (Å/min) | % NU |
|---|---|---|---|---|
| 25 | 60 | 10220 | 2074 | 8.89 |
| 24 | 60 | 9922 | 2422 | 5.12 |
| 23 | 60 | 9685 | 2622 | 4.50 |
| 22 | 60 | 9978 | 2335 | 4.64 |
| 21 | 60 | 9894 | 2412 | 1.49 |
| 20 | 60 | 9898 | 2463 | 4.34 |
| 19 | 60 | 9895 | 2428 | 2.90 |
| 18 | 60 | 9831 | 2516 | 3.59 |
| 17 | 60 | 9778 | 2581 | 2.36 |
| 16 | 60 | 9807 | 2585 | 2.14 |
| 15 | 60 | 9692 | 2687 | 3.73 |
| 14 | 60 | 9196 | 2633 | 1.77 |
| 13 | 60 | 9202 | 2649 | 4.10 |

Based on the foregoing test results, the article of Example 2 achieved a mean removal rate of 2527 Angstroms per minute with a 3.39% NU (Non-Uniformity) for the final 12 wafers. Following the polishing test, visual examination of the pad indicated that several patches, approximately 2 mm in diameter, were present on the working surface of the pad. The patches appear to be incompletely heated portions of the polymer which were not correctly embossed. The article of Example 1 achieved a mean removal rate of 2821 Angstroms per minute with a 9.08% NU (non-uniformity) for the final 7 wafers. It was observed that the working liquid went from clear to a green color in the testing of Example 1 during the fourth test interval (wafer 9), indicating the initiation of copper removal. Conditioning of the abrasive article prior to polishing is expected to achieve immediate copper removal with these articles.

While the foregoing preferred embodiment for the present invention described a method for the chemical mechanical planarization of semiconductor surfaces, it will be appreciated that the described method is applicable to the modification of any of a variety of surfaces. In particular, the described abrasive articles may be used in the surface modification of a variety of sputtered metallic coatings for computer memory discs wherein the metallic coating is typically deposited (e.g., by sputtering) on glass, aluminum, glass-ceramic or another suitable substrate. The described metallic coatings may be removed from the substrate or otherwise modified according to the present invention. In general, the described articles and the method for their use in the modification of a surface may be adapted for any of a variety of abrasive operations and is though to be especially applicable to the surface modification of surfaces that meet the hardness criteria described hereinabove.

While a preferred embodiment of the invention has been described in detail, it will be appreciated that changes to the described embodiment may be made to those skilled in the art without departing from the spirit of the invention.

What is claimed is:

1. A method of modifying a surface comprising the steps of:

(a) contacting the surface to be modified with a working surface of an abrasive article the working surface comprising a phase separated polymer having a first phase and a second phase, the first phase being harder than the second phase; and (b) relatively moving the surface to be modified and the abrasive article to remove material from the surface to be modified in the absence of an abrasive slurry.

2. A method according to claim 1 wherein the work to failure for the phase separated polymer is greater than the work-to-failure for the material removed from the surface of the wafer.

3. A method according to claim 1 wherein the first phase of the phase separated polymer is harder than the material removed from the surface of the wafer.

4. A method according to claim 1 wherein the phase separated polymer is a block copolymer selected from the group consisting of A-B diblock copolymer, A-B-A triblock copolymer, A-B-A-B tetrablock copolymer, A-B multiblock and star block copolymer.

5. A method according to claim 1 wherein the phase separated polymer is a styrene-butadiene-styrene copolymer.

6. A method according to claim 5 wherein styrene is present within the phase separated polymer in an amount sufficient to form hard segments having an average diameter between about 50 Angstroms and about 100 Angstroms.

7. A method according to claim 1 wherein the phase separated polymer is a styrene-ethylene-butadiene-styrene copolymer.

8. A method according to claim 1 wherein contacting the surface to be modified with a working surface of an abrasive article is at a pressure no greater than about 10 psi.

9. A method according to claim 1 further comprising contacting the surface to be modified with a working surface of an abrasive article in the presence of a liquid.

10. A method according to claim 9 wherein the liquid has a pH of at least about 5.

11. A method according to claim 1 wherein the liquid comprises water.

12. A method according to claim 1 wherein the surface to be modified comprises a metal, metal oxide or combinations of the foregoing.

13. A method according to claim 1 wherein the surface to be modified comprises silicon dioxide.

14. A method according to claim 1 further comprising relatively moving said wafer and said fixed abrasive article to modify said surface of said wafer to create a surface having an Ra value of no greater than about 20 Angstroms.

15. A method according to claim 1 further comprising relatively moving said wafer and said fixed abrasive article to achieve an average cut rate of at least about 500 Angstroms/minute to modify the surface of the wafer.

16. A method according to claim 1 wherein the fixed abrasive article further comprises a backing having an abrasive layer thereon, the abrasive layer comprising the phase separated polymer.

17. A method according to claim 16 wherein the backing comprises a polymer film and a primer for enhancing adhesion between the abrasive layer and said backing.

18. A method according to claim 1 wherein the surface of the abrasive article is erodible.

19. A method according to claim 1 wherein the surface of the fixed abrasive article comprises a plurality of abrasive composites arranged in a pre-determined pattern.

20. A method according to claim 19 wherein the abrasive composites are precisely shaped abrasive composites.

21. A method according to claim 19 wherein substantially all of the abrasive composites have substantially the same shape.

22. A method according to claim 19 wherein the abrasive composites have a shape selected from the group consisting of cubic, cylindrical, prismatic, pyramidal, truncated pyramidal, conical, truncated conical, post-like with a flat top surface, hemispherical, and combinations thereof.

23. A method according to claim 19 wherein the abrasive composites are spaced apart from each other.

24. A method according to claim 19 wherein the fixed abrasive article comprises a backing having a surface comprising said abrasive composites in the form of a coating, each of the abrasive composites having substantially the same orientation relative to the backing.

25. A method according to claim 1 wherein the abrasive article is secured to a subpad.

26. A method according to claim 9 wherein the liquid comprises:

(a) ammonium hydrogen phosphate;

(b) hydrogen peroxide;

(c) ammonium citrate; and (d) benzotriazole.

* * * * *

UNITED STATES PATENT AND TRADEMARK OFFICE

CERTIFICATE OF CORRECTION

PATENT NO. : 6,234,875 B1
DATED : May 22, 2001
INVENTOR(S) : Daniel B. Pendergrass It is certified that error appears in the above-identified patent and that said Letters Patent is hereby corrected as shown below:

Column 6,
Line 58, "bock" should read -- block --;

Column 7,
Line 26, delete "." after the word "phase";
Line 59, "sytrene:" should read -- styrene: --;
Line 63, "sytrene:" should read -- styrene: --;

Column 11,
Line 1, "Id." should read -- ID. --;

Signed and Sealed this

Fourth Day of June, 2002

*Attest:*

*Attesting Officer*

JAMES E. ROGAN
*Director of the United States Patent and Trademark Office*